United States Patent [19]

Fujiyoshi

[11] Patent Number: 4,808,778

[45] Date of Patent: Feb. 28, 1989

[54] SWITCHING APPARATUS HAVING A ROCKING ELEMENT

[75] Inventor: Shiori Fujiyoshi, Tokyo, Japan

[73] Assignee: Jimbo Electric Co., Ltd., Tokyo, Japan

[21] Appl. No.: 85,292

[22] Filed: Aug. 13, 1987

Related U.S. Application Data

[63] Continuation of Ser. No. 854,814, May 5, 1906, abandoned.

[30] Foreign Application Priority Data

Jun. 26, 1985 [JP] Japan ..... 60-137670

[51] Int. Cl.[4] ..... H01H 3/20

[52] U.S. Cl. ..... 200/33.9; 200/409

[58] Field of Search ..... 200/339, 330, 315, 67 D, 200/67 DB, 329, 328, 6 R, 6 C

[56] References Cited

U.S. PATENT DOCUMENTS

| | | | |
|---|---|---|---|
| 1,694,569 | 12/1928 | Walsh | 200/67 DB |
| 2,395,698 | 2/1946 | Tiffany | 200/67 DB |
| 2,444,529 | 7/1948 | Poster | 200/67 DB |
| 3,090,846 | 5/1963 | Tateishi | 200/67 DB |
| 3,092,698 | 6/1963 | Brenneman | 200/67 DB |
| 3,134,881 | 5/1964 | Powell | 200/329 |
| 4,221,941 | 9/1980 | Genovese | 200/329 X |
| 4,242,552 | 12/1980 | Tibolla | 200/339 |
| 4,293,753 | 10/1981 | Kanada | 200/715 |
| 4,496,802 | 1/1985 | Rose et al. | 200/5 R |
| 4,575,596 | 3/1986 | Thorsen et al. | 200/67 D |

FOREIGN PATENT DOCUMENTS

| | | | |
|---|---|---|---|
| 1640538 | 9/1970 | Fed. Rep. of Germany | 200/339 |
| 2260708 | 6/1974 | Fed. Rep. of Germany | 200/339 |
| 2413897 | 10/1975 | Fed. Rep. of Germany | 200/339 |
| 47946 | 5/1966 | German Democratic Rep. | 200/329 |
| 1529149 | 10/1978 | United Kingdom | 200/67 DB |

*Primary Examiner*—Henry J. Recla
*Assistant Examiner*—Ernest G. Cusick
*Attorney, Agent, or Firm*—Wegner & Bretschneider

[57] ABSTRACT

An improved switching apparatus comprising a housing defined by a casing body with an upper lid and fixed and movable contacts built within the housing which are capable of being opened or closed by the manipulation of an operable member supported on the upper lid. Switch connections are achieved in engaging portions at the lower end of a movable contactor having a movable contact. The engaging portions are supported at and extend from the lower end of the movable contactor. The movable contact of the movable contactor is located opposite a fixed contact.

7 Claims, 5 Drawing Sheets

SWITCHING APPARATUS HAVING A ROCKING ELEMENT

This application is a continuation of application Ser. No. 859,814, filed May 5, 1986 now abandoned.

BACKGROUND OF THE INVENTION

1. Field of the Invention

The present invention relates to a switch arrangement for holding a load on or off by the inversion of an operable element.

2. Statement of the Prior Art

As illustrated in FIGS. 9 to 11 inclusive, such a type of switch includes a switch element 5 which is turnable around its central axis upon receiving a push at one end. A narrow frame 6 formed on the back side of that element gives a rotational force to a shaft 3 which is in engagement therewith, thereby turning the shaft 3 in the direction counter to the turning of the switch element 5. When grooves 2 in the shaft 3 for supporting a movable frame 7 are horizontally positioned, frame 7 bends an elastic tongue 10 of a lower terminal plate 9. Consequently, a contact 8 rivetted to the central elastic tongue of the movable frame 7 slides over the contact surface of a contact 16 of an upper terminal 15. If the grooves 2 for supporting the movable frame 7 pass over the horizontal line, then the right and left halves of the movable frame 7 move downwardly and upwardly, respectively, due to the restoring force of the elastic tongue 10 of the lower terminal plate 9. At the same time, the contact 16 of the upper terminal 15 is rapidly connected from the contact 8 of the movable frame 7 to shut off the circuit, so that the movable frame 7 comes to a halt, upon abutting a control plate 17. When pushing the other end of the switch element 5, the operation counter to the foregoing operation takes place, so that the contact 8 comes into contact with the contact 16 to close the circuit.

In the switch arrangement as explained in the foregoing, since the movable frame 7 is constantly held between the grooves 2 formed on both sides of the shaft 3 and a notch 11 formed on the upper end of the elastic tongue 10 formed at the middle of the lower terminal plate 9, an amount of heat is generated in notch 11 to interfere with the switching operation of the switch. There is another disadvantage in the above-described switch arrangement in that, since the switch element 5 and shaft 3 are built in a housing 4 into which the terminal plate 9 is fixedly inserted, the assemblage thereof is very cumbersome. In addition, unless the movable frame halves 7 and 7 are provided on both sides of the shaft 3, any stable operation of switching is not attainable.

There is a disadvantage in having an amount of heat generated at a portion for supporting a movable contact, thereby interfering with the operation of switching. For instance, in operating an incandescent lamp, an overcurrent occurs during switching, resulting in arcing. This then leads to fusing of contacts and non-inversion of a switch element, thus making opening of the contacts impossible.

SUMMARY OF THE INVENTION

In view of the foregoing problems, an object of the present invention is to provide a novel switch arrangement which includes contact portions having improved durability and reliability, assures opening of contacts by reducing the amount of inversive movement of an operable element, and is easy to assemble.

According to one aspect of the present invention, there is provided a switch arrangement comprising a housing defined by a casing body and an upper lid, and fixed and movable contacts built in the housing, which are capable of being opened or closed by the manipulation of an operable element supported on the upper lid.

Connection is made between engaging portions formed at the lower end of a movable contactor having a movable contact the engaging portions are supported through bending and extending from the lower end of said movable contactor. The movable contact of said movable contactor is located opposite to a fixed contact.

According to another aspect of the present invention, there is also provided a switch arrangement including a casing body, an upper lid member attached to said casing body, an operable element supportingly inserted into said upper lid from about and formed at its lower portion with means to be engaged, a retainer spring provided with means by bending in the opposite directions, said means being adapted to hold said operable element and said upper lid in a rocking manner and hold locking means and a face plate in a detachable manner, a switching element inserted and supported in and on said upper lid from below and formed on its upper portion with means adapted to engage said means to be engaged and on its lower portion with inversion driving means for a movable contactor, a movable contact, and a fixed contact located in opposition to said movable contact.

Many other additional advantages, features and objects of the present invention will become apparent to those skilled in the art upon making reference to the detailed description and the accompanying drawings on which preferred structural embodiments incorporating the principles of the invention are shown by way of illustrative examples.

DETAILED DESCRIPTION OF THE PREFERRED EMBODIMENT

A box-like casing body generally shown at 20 has an upper lid member 22 thereon. More specifically, the lid member 22 is secured to the casing body 20 by caulking of an end 23*a* of a mounting plate 23. A threaded hole 23*b* is provided in a frame for threaded attachment of a switch to an application wall.

Figure 5:
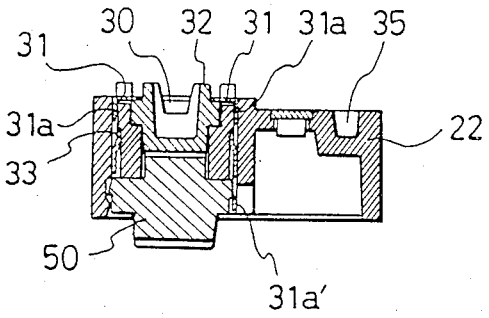
FIG. 5 is a sectional view taken along the line C—C of FIG. 2.
Figure 6A:
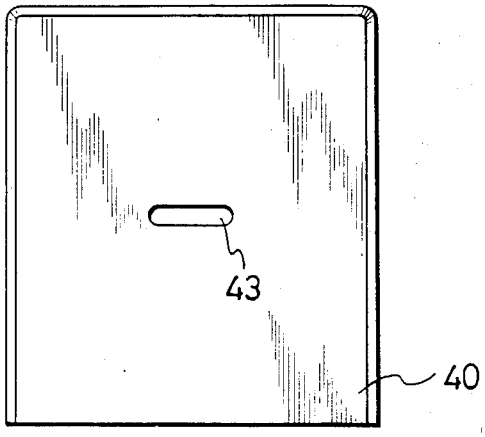
FIG. 6(A) is a plan view showing a face plate used in the foregoing embodiment.
Figure 6B:
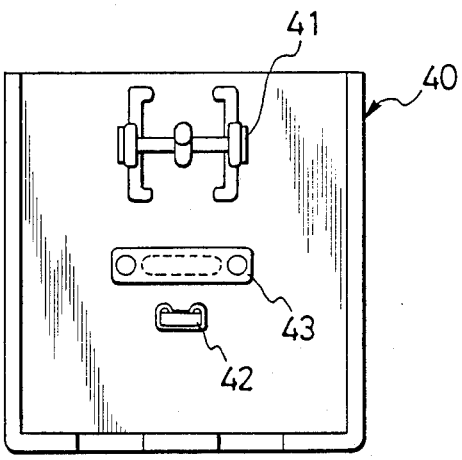
FIG. 6(B) is a bottom view of that the face plate of FIG. 6(A)
Figure 6C:
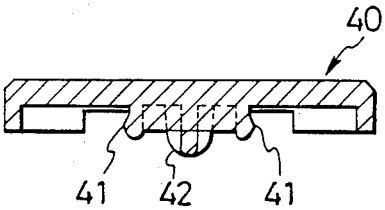
FIG. 6(C) is a longitudinally sectional view of the face plate of FIG. 6(A)

An operable element 30 is supported on the lid member 22 and, as illustrated in FIGS. 6(A)–(C), receives thereon a face plate 40. The operable element 30 is provided with a retainer spring 31 including a member 33 for rockingly holding together the upper lid and operable element and a member 32 for removably holding the face plate 40, both members 33 and 32 being formed in the opposite directions by bending. A recess 35 is located in an upper portion of the lid member 22. The first protrusion 41 of the face plate 40 is fitted into the second holding means 32, while the second protrusion 42 of the face plate 40 is fitted into the recess 35. The arrangement as mentioned above assures the inversion of the operable element 30 which is effected by giving a push to any position of the face plate 40. The operable element 30 is supported on the upper lid member 22 by fitting the end portion 31*a* of the retainer spring 31 and the operable element 30 into the upper lid 22 in an integrally rockable manner, thereby securing the first member 33 in place, as illustrated in FIG. 5. On the other hand, the operable element 30 is integrally provided on the lower portion with forked member 34.

A switching element 50 is inserted into the upper lid 22 from below, and is supported in-between the operable element 30 and the other end portion 31*a* of the spring retainer 31. The switching element 50 is formed as one piece with three-forked member 51 for engagement with the forked member 34 of the operable element 30, and is made swingable, following the shape of an inner face 22*a* of the upper lid 22. The switching element 50 is also grooved at 52 at the end of its lower portion.

A movable contactor 60 is constructed of engaging members 61 to be engaged in a groove 52 in the switching element 50 and in the vicinity of the bottom of the casing body 20, corrugated member 62 extending from its lower end, and member 63 provided contiguous to the corrugated member 62 and adapted to be fixed to the bottom of the casing body 20. In the arrangement as mentioned just above, it is possible to reduce the amount of elastic deformation of the corrugated member 62, as compared to the width of inversive movement of the movable contactor 60. Only a slight amount of elastic deformation can thus be absorbed in the corrugated member 62, leading to an increase in the service life of the switch arrangement. Contiguous to the movable contactor 60, is a movable plate 64 through an inverse U-shaped opening 65, to which a movable contact 66 is attached. More specifically, the opening 65 is provided in the vicinity of the movable contact 66 which can follow the rocking movement of the movable contactor 60. On the other hand, supporting member 67 has at one end a bent supporting portion 67*a* for supporting an engaging portion 61 at the lower end of the movable contactor 60 and at the other end a fixing piece 67*b* adapted to be connected to the fixing piece 63 of the movable contactor 60. It is noted that both fixing pieces 63 and 67*b* are not always required to be connected with each other, and may be provided as one piece. It is also noted that the corrugated member 62 of the movable contactor 60 and the supporting portion 67*a* of the supporting piece 67 may be reversed in position.

The casing body 20 is provided with fixed contacts 70 and 72 and with fixed terminals 79*a* and 79*b* comprised of leads (not shown) to be connected with each other and keep springs 71 and 73 for holding the leads. Release buttons 74 and 75 are pushed in the bending direction of the keep springs 71 and 73 by means of a screw driver, etc. through insertion holes 76 and 77, thereby making the detachment of the leads possible.

Figure 7:
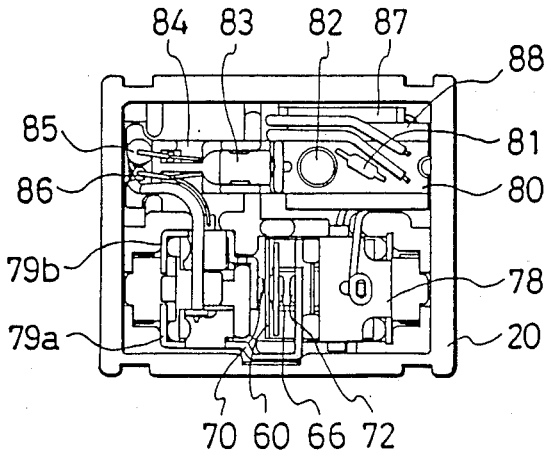
FIG. 7 is a plan view showing the foregoing embodiment from which the upper lid member has been removed.
Figure 8:
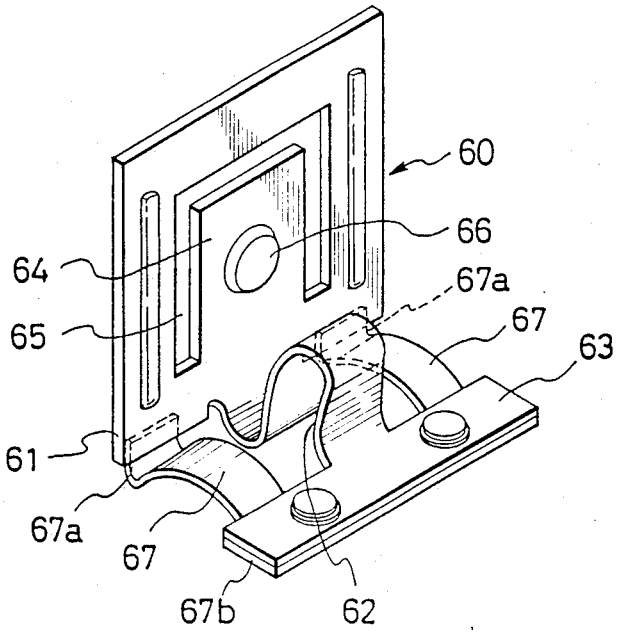
FIG. 8 is a perspective view showing a movable element and a supporting piece used in the foregoing embodiment.
Figure 9:
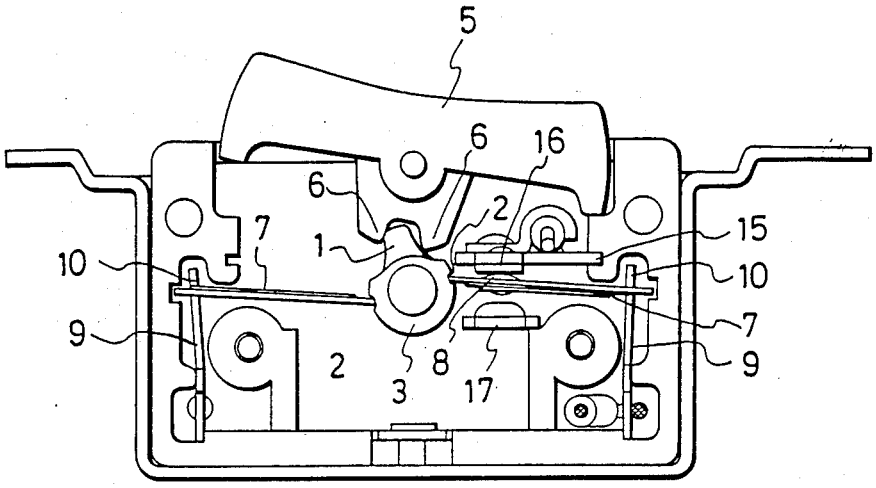
FIG. 9 is a longitudinally sectional view showing one example of the prior art switch arrangement.
Figure 10:
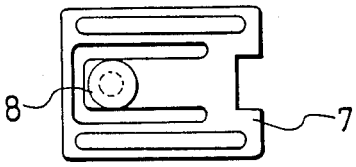
FIG. 10 is a plan view showing a movable frame used in the prior art switch.
Figure 11:
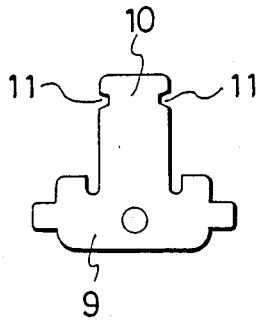
FIG. 11 is a plan view showing a lower terminal plate used in the prior art switch.

A printed circuit board 80 is attached within the casing body 20, as illustrated in FIG. 7, and includes thereon protective and light-emitting diodes 81 and 82. A lamp holder 84 for holding a neon tube 83 is provided with resistors 85 and 86. Furthermore, the printed circuit board 80 includes on the back side a current transformer 87 through an insulating plate 88. The movable contactor 60 is insulated from a terminal 78 with an insulator 20*a*. The current transformer 87 is connected on the primary side between the movable contactor 60 and the terminal 78, and on the secondary side to the printed circuit board 80 on which the light-emitting diode 82 is disposed. The diode 82 emits light, while the switch is held on, so that a display portion 43 of the face plate 40 is lit up through a light-transmitting portion 22*b* formed on the upper lid 22. In this connection, it is noted that the light-emitting diode 82, light-transmitting portion 22*b* and display portion 43 are located at the same position. Between the fixed terminals 79*a* and 79*b*, there is connected a circuit formed by parallel-connecting of a resistor to a series circuit comprised of the neon tube 83 and the resistor 85, said resistor being designed to prevent lighting-up of minute spots due to wiring floating capacity. While the switch is held off, the neon tube 83 is lit up, developing a color different from that of light-emitting diode 82 offering visual perception through the display portion 43 of the face plate 40 by way of the light-transmitting portion 22*b*, as is the case with the light-emitting diode 82. In this embodiment, the diode 82 is lit up, while the switch is held on, and the neon tube 83 is lit up, while the switch is held off, thus making intermediate perception possible.

Figure 1A:
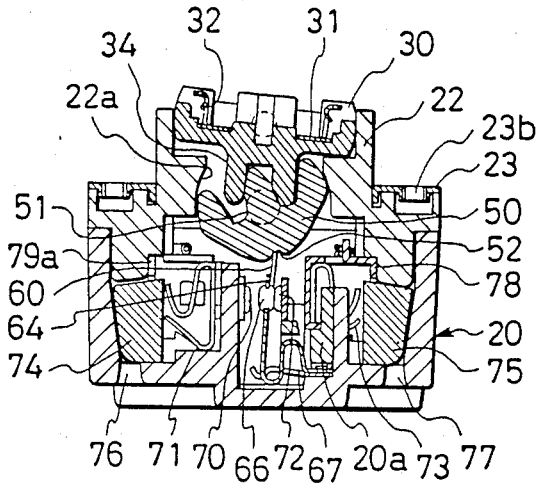
FIG. 1(A) is a longitudinally sectional view showing one embodiment of the present invention, from which a face plate has been removed.
Figure 1B:
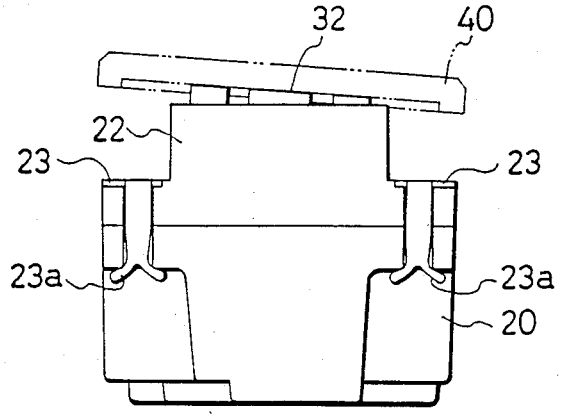
FIG. 1(B) is a front view of FIG. 1(A)
Figure 2:
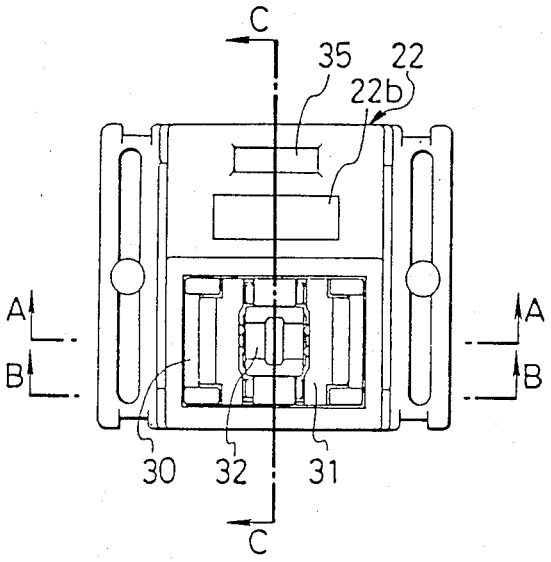
FIG. 2 is a plan view showing an operating element, an inverter or switching element and a retainer spring assembled together on an upper lid member in the foregoing embodiment.
Figure 3:
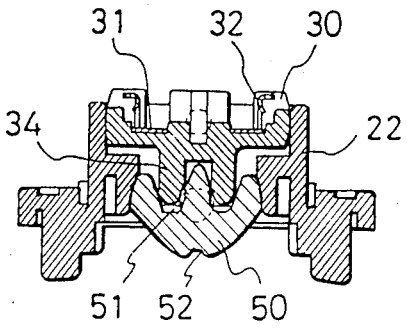
FIG. 3 is a sectional view taken along the line A—A of FIG. 2.
Figure 4:
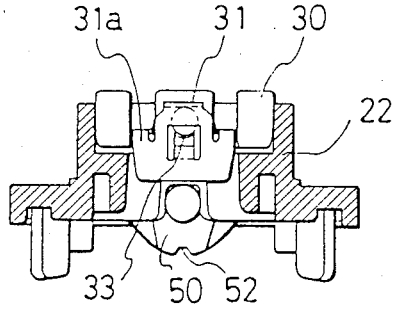
FIG. 4 is a sectional view taken along the line B—B of FIG. 2.

In the foregoing embodiment, a push is given to the face plate 40, as illustrated in FIG. 1(B). Thereafter, rocking movement of the operable element 30 takes place in FIG. 1(A), whereby the inversion of the switching element 50 takes place through the engaging portion 51 to effect the rocking movement of the movable contactor 60. The rocking movement of the movable contact 66 of the movable plate 64 takes place to bring it into contact with the fixed contact 72, whereby the contacts 66 and 72 touch, while the contacts 66 and 70 are separated. On the other hand, when a push is given to the face plate 40 in the opposite direction, reverse rocking movement of the operable element 30, switching element 50, movable contactor 60 and movable contact 66 takes place to bring the movable contact 66 into contact with the fixed contact 70, whereby the contacts 66 and 72 are held off therebetween, while the contacts 66 and 70 are held on therebetween.

As mentioned in the foregoing, since the operable element 30 and switching element 50 are supported on the upper lid 22 for opening and closing the movable contact 66 in the embodiment as explained in the foregoing, the respective parts work in association with each other. Only slight inverse movement of the face plate 40 allows to increase the width of the swing of the movable contact 66. The movable plate 64 having the movable contact 66 is not in direct engagement within the groove 52 in the switching element 50, and produces its rotational force through the movable contactor 60. Thus, the movable contact 66 is slidably separated away from the fixed contact 70 to prevent fusing of the contacts at the time of switching-on. Also, since a current passes through the corrugated member 62 of the movable contactor 60, no heat is generated between the engaging portion 61 and the supporting portion 67*a* of the movable contactor 60. Furthermore, even where the corrugated member 62 of the movable contactor 60 breaks when the mechanical service life is exceeded, the engaging portion 61 of the movable contactor 60 is supported on the supporting portion 67*a*, so that the movable contact 66 is made electrically conductive through the supporting piece 67 with no fear of nonconduction. This results in an increase in the service life of the switch arrangement.

According to another advantage of the present invention, the width of the swing of the movable contact can be increased by only slight inverse movement of the face plate, so that the face plate having an operable surface larger than the switch body can detachably be retained. Also, the switch body can easily be assembled.

Obviously, many modifications and variations of the present invention are possible in the light of above teachings. It is therefore to be understood that within the scope of the appended claims, the invention may be practiced otherwise than as specifically described.

What is claimed is:

1. An improved switching apparatus, comprising:

a casing body;

an upper lid member attached to said casing body;

a switching element disposed within said casing body;

a movable contactor engaged by the switching element, said movable contactor having a movable contact attached thereto;

a fixed contact located opposite the movable contact;

an operable element inserted into said upper lid member, a substantial part of an upper portion of the operable element being supported by the upper lid member, and a lower portion of the operable element being engaged with the switching element so that said operable element and said switching element rotate in opposite directions;

a face plate; and a retainer spring having first and second members which are bent in opposite directions, the first member of the retaining spring holding the operable element to the upper lid member in a rocking manner, the second member of the retaining spring detachably connecting the face plate to the operable element.

2. A switch arrangement as claimed in claim 1, wherein said switching element comprises an inverse driving means for moving said movable contactor, said inverse driving means comprising a groove formed in a lower portion of said switching element which receives an upper portion of the movable contactor; and wherein said switch arrangement further comprises a support member attached to a bottom portion of the switch body and having a bent supporting portion, and said movable contactor comprises an engaging member formed at a lower portion thereof which is engaged by said bent supporting portion, and a corrugated member extending between the engaging member and the support member.

3. A switch arrangement as claimed in claim 2, wherein said movable contactor further comprises a movable plate defined by a notch in the movable contactor, and said movable contact is attached to the movable plate.

4. A switch arrangement as claimed in claim 3, wherein said upper lid member is provided with a recess, and wherein said face plate has a first protrusion which is engaged by the second member of the retaining spring and a second protrusion which is received by the recess of the upper lid portion.

5. A switch arrangement as claimed in claim 2, wherein said upper lid member is provided with a recess, and wherein said face plate has a first protrusion which is engaged by the second member of the retaining spring and a second protrusion which is received by the recess of the upper lid portion.

6. A switch arrangement as claimed in claim 1, wherein said upper lid member is provided with a recess, and wherein said face plate has a first protrusion which is engaged by the second member of the retaining spring and a second protrusion which is received by the recess of the upper lid portion.

7. An improved switching apparatus comprising:

a housing comprising a casing body and an upper lid;

a switching element disposed within the housing;

an operable element supported on the upper lid of the housing, said operable element being engaged with the switching element so that the operable element and switching element move in opposite directions;

at leaast one fixed contact located within the housing;

a movable contactor and a support member located within the housing, said movable contactor being engagable with said switching element and comprising an engaging member, a corrugated member extending between the engaging member and the support member, a movable plate defined by a notch in the movable contactor, and a movable contact attached to the movable plate and located opposite said fixed contact, said support member having a bent supporting portion which engages a lower portion of said engaging member;

wherein when said switching element is activated to move said movable contactor, said support member moves so as to cause the movable contact of the movable contactor to move and slide toward and away from the fixed contact.

* * * * *